US009485556B1

(12) United States Patent
List

(10) Patent No.: US 9,485,556 B1
(45) Date of Patent: Nov. 1, 2016

(54) SPEAKER ARRAY FOR SOUND IMAGING

(75) Inventor: Timothy T. List, Santa Cruz, CA (US)

(73) Assignee: Amazon Technologies, Inc., Seattle, WA (US)

( * ) Notice: Subject to any disclaimer, the term of this patent is extended or adjusted under 35 U.S.C. 154(b) by 732 days.

(21) Appl. No.: 13/534,978

(22) Filed: Jun. 27, 2012

(51) Int. Cl.
*H04R 25/00* (2006.01)
*H04R 1/00* (2006.01)

(52) U.S. Cl.
CPC ..... *H04R 1/00* (2013.01); *H04R 2201/401* (2013.01); *H04R 2201/405* (2013.01); *H04R 2205/022* (2013.01)

(58) Field of Classification Search
CPC ..... H04R 1/00; H04R 2205/022; H04R 2201/401; H04R 2201/405
USPC ..... 381/182
See application file for complete search history.

(56) References Cited

U.S. PATENT DOCUMENTS

2005/0025318 A1* 2/2005 Sadaie et al. ..... 381/63
2009/0316938 A1* 12/2009 Matsumoto ..... 381/300
2011/0019853 A1* 1/2011 Chang ..... 381/338
2012/0223885 A1 9/2012 Perez
2012/0259638 A1* 10/2012 Kalinli ..... 704/270
2013/0131836 A1* 5/2013 Katz et al. ..... 700/12

FOREIGN PATENT DOCUMENTS

WO WO2011088053 7/2011

OTHER PUBLICATIONS

Pinhanez, "The Everywhere Displays Projector: A Device to Create Ubiquitous Graphical Interfaces", IBM Thomas Watson Research Center, Ubicomp 2001, 18 pages.

* cited by examiner

*Primary Examiner* — Duc Nguyen
*Assistant Examiner* — Sean H Nguyen
(74) *Attorney, Agent, or Firm* — Lee & Hayes, PLLC

(57) ABSTRACT

In an augmented reality environment, a speaker array is centrally located within an area to generate sound for the environment. The speaker array has a spherical or hemispherical body and speakers mounted about the body to emit sound in multiple directions. A controller is provided to select sets of speakers to form beams of sound in determined directions. The shaped beams are output to deliver a full audio experience in the environment from the fixed location speaker array.

19 Claims, 5 Drawing Sheets

SPEAKER ARRAY FOR SOUND IMAGING

BACKGROUND

Augmented reality allows interaction among users, real-world objects, and virtual or computer-generated objects and information within an environment. The environment may be, for example, a room equipped with computerized projection and imaging systems that enable presentation of images on various objects within the room and facilitate user interaction with the images and/or objects. The augmented reality may range in sophistication from partial augmentation, such as projecting a single image onto a surface and monitoring user interaction with the image, to full augmentation where an entire room is transformed into another reality for the user's senses. The user can interact with the environment in many ways, including through motion, gestures, voice, and so forth.

One of the challenges associated with augmented reality is creation of high quality sound within the environment. This is particularly the case when certain objects and/or users are moving about within the environment. There is a continuing need for improved systems that create a richer audio experience for the user, even in environments with moving objects and/or people.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Augmented reality environments allow users to interact with physical and virtual objects in a physical space. Augmented reality environments are formed through systems of resources such as cameras, projectors, computing devices with processing and memory capabilities, and so forth. The projectors project images onto the surroundings that define the environment and the cameras monitor and capture user interactions with such images.

An augmented reality environment is commonly hosted or otherwise set within a surrounding area, such as a room, building, or other type of space. In some cases, the augmented reality environment may involve the entire surrounding area. In other cases, an augmented reality environment may involve a localized area of a room, such as a reading area or entertainment area.

Described herein is an architecture to create an augmented reality environment and to generate a rich audio experience within the environment from a fixed location speaker array. The architecture may be implemented in many ways. One illustrative implementation is described below in which an augmented reality environment is created within a room. The architecture includes one or more projection and camera systems, as well as a centrally mounted speaker array. The various implementations of the architecture described herein are merely representative.

Illustrative Environment

Figure 1:
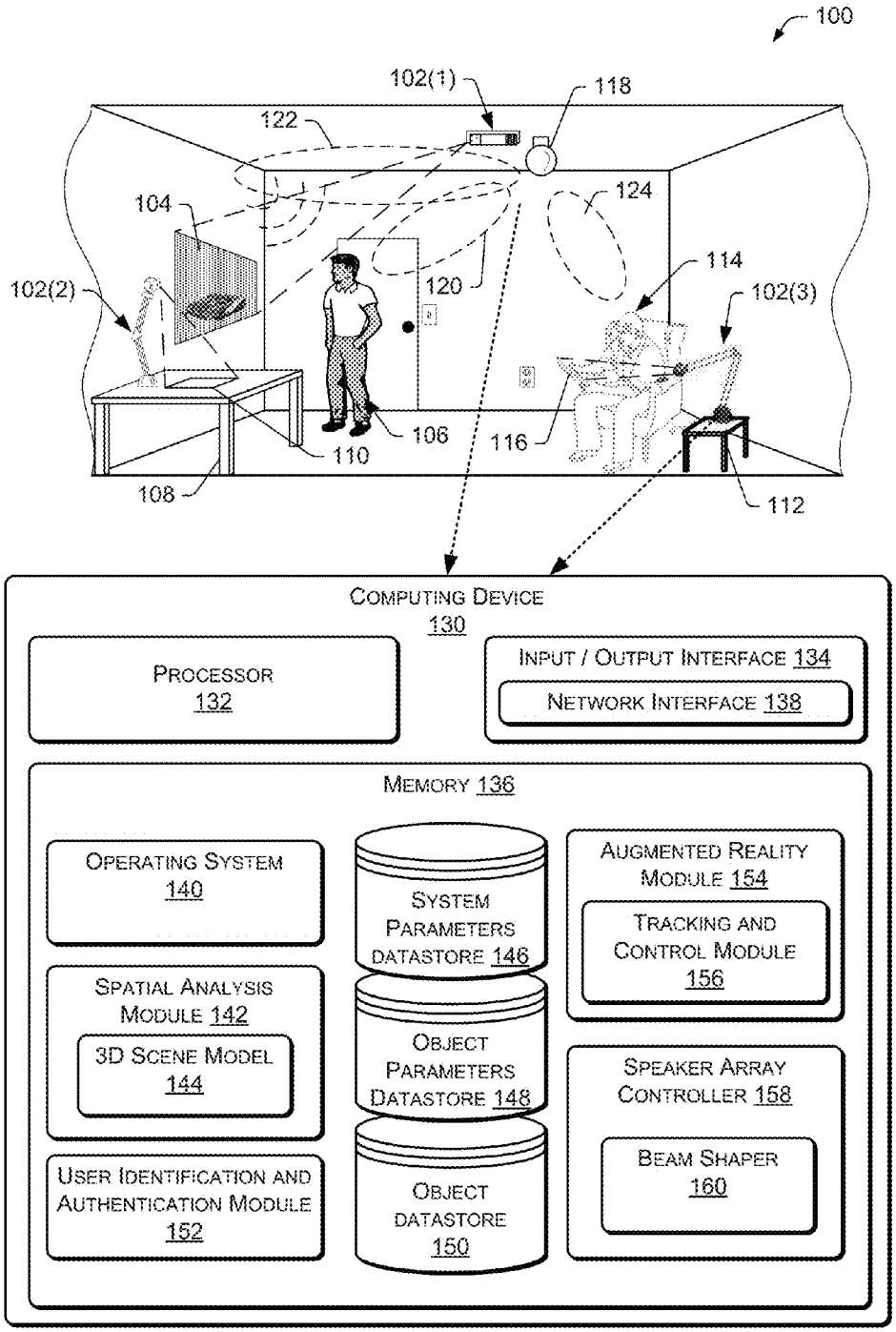
FIG. 1 shows an illustrative scene with an augmented reality environment hosted in an environmental area, such as a room. The augmented reality environment is provided, in part, by three projection and image capture systems. Additionally, a sound system with a spherical speaker array is provided centrally in the room to provide an enriched audio experience throughout the environment.

FIG. 1 shows an illustrative augmented reality environment 100 created within a scene, formed within an environmental area, such as a room. Three augmented reality functional nodes (ARFN) 102(1)-(3) are shown within the room. Each ARFN contains projectors, cameras, and computing resources that are used to generate the augmented reality environment 100. In this illustration, the first ARFN 102(1) is a fixed mount system that may be mounted within the room, such as to the ceiling, although other placements are possible. The first ARFN 102(1) projects images onto the scene, such as onto a surface or screen 104 on a wall of the room. A first user 106 may watch and interact with the images being projected onto the wall, and the ceiling-mounted ARFN 102(1) may capture that interaction. One implementation of the first ARFN 102(1) is provided below in more detail with reference to FIG. 2.

A second ARFN 102(2) is embodied as a table lamp, which is shown sitting on a desk 108. The second ARFN 102(2) projects images 110 onto the surface of the desk 108 for the user 106 to consume and interact. The projected images 110 may be of any number of things, such as homework, video games, news, or recipes.

A third ARFN 102(3) is also embodied as a table lamp, shown sitting on a small table 112 next to a chair. A second user 114 is seated in the chair and is holding a portable projection screen 116. The third ARFN 102(3) projects images onto the surface of the portable screen 116 for the user 114 to consume and interact. The projected images may be of any number of things, such as books, games (e.g., crosswords, puzzles, etc.), news, magazines, movies, browser, etc. The portable screen 116 may be essentially any device for use within an augmented reality environment, and may be provided in several form factors. It may range from an entirely passive, non-electronic, mechanical surface to a full functioning, full processing, electronic device with a projection surface.

These are just sample locations. In other implementations, one or more ARFNs may be placed around the room in any number of arrangements, such as on in furniture, on the wall, beneath a table, and so forth.

Each of the ARFNs 102(1)-(3) may be equipped with one or more microphones to capture audio sound within the environment as well as with one or more speakers to output sound into the environment. Additionally or alternatively, the architecture includes a standalone speaker array 118 mounted centrally of the room. In this example, the speaker array 118 is mounted to the ceiling in a fixed location at approximately the center of the room. However, other locations are possible.

The speaker array 118 is configured to provide full spectrum, high fidelity sound within the environment 100. The speaker array 118 is illustrated as a sphere with multiple speakers mounted thereon to output sound in essentially any direction. The multiple speakers may be individually controlled to form directional beams that may be essentially "aimed" in any number of directions. Beam shaping relies on various techniques, such as time delays between applying the audio signal to two or more different speakers.

In FIG. 1, multiple beams are shown emanating from the speaker array 118. A first beam 120 is directed at the user 106 to provide primary channel sound to the user who is watching a program on the screen or surface 104. A second beam 122 is directed to the wall that contains the screen or surface 104, where the sound is reflected back toward the user 106. This reflected sound may carry, for example, background audio components, such as that used in surround sound. The beams are timed such that the primary beam 120 reaches the user 106 at a suitable time in coordination with the reflected beam 122 providing stereo and surround sound characteristics. These first two beams 120 and 122 thereby provide a rich audio experience for the user 106 who is watching the video program being projected onto the screen 104.

Concurrent with the first two beams 120 and 122, a third beam 124 is shown directionally output toward the user 114 seated in the chair. Suppose that the seated user 114 is listening to an audio book or to music while reading an electronic book projected onto the screen 116. The third beam 124 carries this separate audio to the user 114 to provide an enhanced audio experience, while the other two beams 120 and 122 continue to provide rich sound entertainment to the standing user 106 in the room.

Associated with each ARFN 102(1)-(3), or with a collection of ARFNs, is a computing device 130, which may be located within the augmented reality environment 100 or disposed at another location external to it. Each ARFN 102 may be connected to the computing device 130 via a wired network, a wireless network, or a combination of the two. The computing device 130 has a processor 132, an input/output interface 134, and a memory 136. The processor 132 may include one or more processors configured to execute instructions. The instructions may be stored in memory 136, or in other memory accessible to the processor 132, such as storage in cloud-based resources.

The input/output interface 134 may be configured to couple the computing device 130 to other components, such as projectors, cameras, microphones, other ARFNs, other computing devices, and so forth. The input/output interface 134 may further include a network interface 138 that facilitates connection to a remote computing system, such as cloud computing resources. The network interface 138 enables access to one or more network types, including wired and wireless networks. More generally, the coupling between the computing device 130 and any components may be via wired technologies (e.g., wires, fiber optic cable, etc.), wireless technologies (e.g., RF, cellular, satellite, Bluetooth, etc.), or other connection technologies.

The memory 136 may include computer-readable storage media ("CRSM"). The CRSM may be any available physical media accessible by a computing device to implement the instructions stored thereon. CRSM may include, but is not limited to, random access memory ("RAM"), read-only memory ("ROM"), electrically erasable programmable read-only memory ("EEPROM"), flash memory or other memory technology, compact disk read-only memory ("CD-ROM"), digital versatile disks ("DVD") or other optical disk storage, magnetic cassettes, magnetic tape, magnetic disk storage or other magnetic storage devices, or any other medium which can be used to store the desired information and which can be accessed by a computing device.

Several modules such as instructions, datastores, and so forth may be stored within the memory 136 and configured to execute on a processor, such as the processor 132. An operating system module 140 is configured to manage hardware and services within and coupled to the computing device 130 for the benefit of other modules.

A spatial analysis module 142 is configured to perform several functions which may include analyzing a scene to generate a topology, recognizing objects in the scene, and dimensioning the objects and physical boundaries (e.g., walls, ceiling, floor, etc.) of the scene. From this, the spatial analysis module 142 creates a 3D model 144 of the scene. The 3D scene model 144 contains an inventory of objects within the scene, the various physical boundaries (e.g., walls, floors, ceiling, etc.), the numerous surfaces provided by the objects and physical boundaries, and dimensions of the rooms. Characterization of the scene may be facilitated using several technologies including structured light, light detection and ranging (LIDAR), optical time-of-flight, ultrasonic ranging, stereoscopic imaging, radar, and so forth either alone or in combination with one another. For convenience, and not by way of limitation, some of the examples in this disclosure refer to structured light although other techniques may be used. The spatial analysis module 142 provides the information used within the augmented reality environment to provide an interface between the physicality of the scene and virtual objects and information.

A system parameters datastore 146 is configured to maintain information about the state of the computing device 130, the input/output devices of the ARFN, and so forth. For example, system parameters may include current pan and tilt settings of the cameras and projectors. As used in this disclosure, the datastore includes lists, arrays, databases, and other data structures used to provide storage and retrieval of data.

An object parameters datastore 148 in the memory 136 is configured to maintain information about the state of objects within the scene. The object parameters may include the surface contour of the object, overall reflectivity, color, and so forth. This information may be acquired from the ARFN, other input devices, or via manual input and stored within the object parameters datastore 148.

An object datastore 150 is configured to maintain a library of pre-loaded reference objects. This information may include assumptions about the object, dimensions, and so forth. For example, the object datastore 150 may include a reference object of a beverage can and include the assumptions that beverage cans are either held by a user or sit on a surface, and are not present on walls or ceilings. The spatial analysis module 142 may use this data maintained in the object datastore 150 to test dimensional assumptions when determining the dimensions of objects within the scene. In some implementations, the object parameters in the object parameters datastore 148 may be incorporated into the object datastore 150. For example, objects in the scene which are temporally persistent, such as walls, a particular table, particular users, and so forth may be stored within the object datastore 150. The object datastore 150 may be stored on one or more of the memory of the ARFN, storage devices accessible on the local network, or cloud storage accessible via a wide area network.

A user identification and authentication module 152 is stored in memory 136 and executed on the processor(s) 132 to use one or more techniques to verify users within the environment 100. In one implementation, the ARFN 102(1) may capture an image of the user's face and the spatial analysis module 142 reconstructs 3D representations of the user's face. Rather than 3D representations, other biometric profiles may be computed, such as a face profile that includes key biometric parameters such as distance between eyes, location of nose relative to eyes, etc. In such profiles, less data is used than full reconstructed 3D images. The user identification and authentication module 140 can then match the reconstructed images (or other biometric parameters) against a database of images (or parameters), which may be stored locally or remotely on a storage system or in the cloud, for purposes of authenticating the user. If a match is detected, the user is permitted to interact with the system.

An augmented reality module 154 is configured to generate augmented reality output in concert with the physical environment. The augmented reality module 154 may employ essentially any surface, object, or device within the environment 100 to interact with the users. The augmented reality module 154 may be used to track items within the environment that were previously identified by the spatial analysis module 142. The augmented reality module 154 includes a tracking and control module 156 configured to track one or more items within the scene and accept inputs from or relating to the items. For instance, the tracking and control module 156 may track portable screens, such as screen 116, so that images are accurately projected onto the movable item. Additionally, the tracking and control module 156 may be used to track other objects as well as the users 106 and 114 within the scene. As the users move about the room or as objects are moved about the room, the tracking and control module 156 tracks the movement and feeds this information to other components within the ARFN 102(1) to determine whether to change any aspects of the augmented reality environment, including the audio output of the speaker array 118.

A speaker array controller 158 is shown stored in the memory 136 for execution on the processor(s) 132. Alternatively, it may be implemented as a hardware or firmware component. The speaker array controller 158 controls the speaker array 118 to output sound in directional beams that can be targeted to specific locations that enhance user experience. The directionality is determined based on any number of sound goals, which might include, for example, high precision sound localization (e.g., for the seated user 114) and/or full spectrum, surround sound (e.g., for the standing user 106). The speaker array controller 158 has a beam shaper 160 to shape audio beams output by a single speaker or sets of speakers within the array 118. The beam shaper 160 chooses which speakers in the array should be used to construct the directional sound beams. The sound beams are essentially sound produced by the speakers that, when output, is more perceptible at certain locations than other locations. Examples of this process are shown and described with reference to FIG. 4.

The ARFNs 102(1)-(3) and computing components of device 130 that have been described thus far may be operated to create an augmented reality environment in which images are projected onto various surfaces and items in the room, and the users 106 and 114 may interact with the images. The users' movements, voice commands, and other interactions are captured by the ARFNs cameras to facilitate user input to the environment.

Example ARFN Implementation

Figure 2:
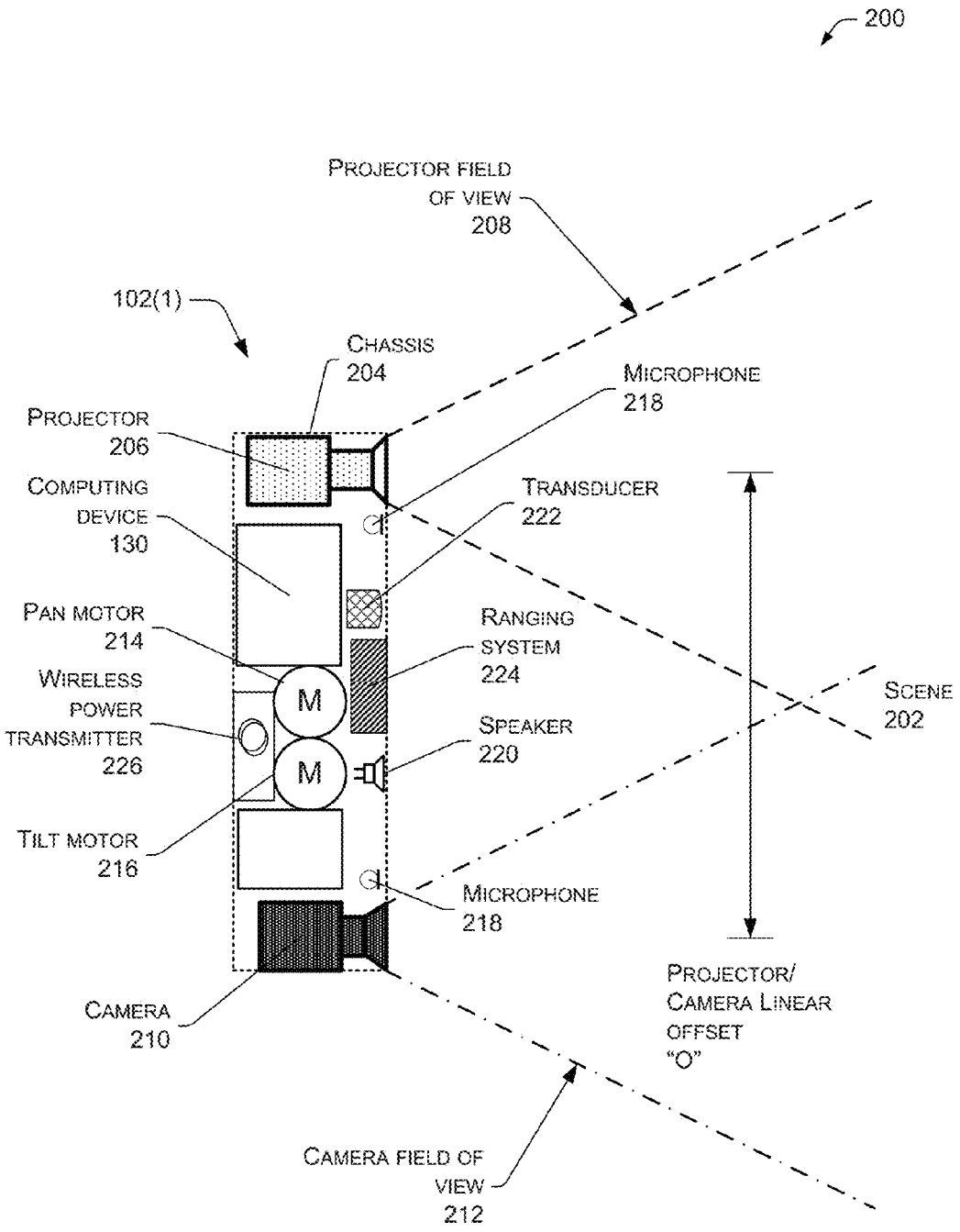
FIG. 2 shows a projection and image capturing system formed as an augmented reality functional node having a chassis to hold a projector and camera in spaced relation to one another.

FIG. 2 shows an illustrative schematic 200 of the first augmented reality functional node 102(1) and selected components. The first ARFN 102(1) is configured to scan at least a portion of a scene 202 and the objects therein. The ARFN 102(1) may also be configured to provide augmented reality output, such as images, sounds, and so forth.

A chassis 204 holds the components of the ARFN 102(1). Within the chassis 204 may be disposed a projector 206 that generates and projects images into the scene 202. These images may be visible light images perceptible to the user, visible light images imperceptible to the user, images with non-visible light, or a combination thereof. This projector 206 may be implemented with any number of technologies capable of generating an image and projecting that image onto a surface within the environment. Suitable technologies include a digital micromirror device (DMD), liquid crystal on silicon display (LCOS), liquid crystal display, 3LCD, and so forth. The projector 206 has a projector field of view 208 which describes a particular solid angle. The projector field of view 208 may vary according to changes in the configuration of the projector. For example, the projector field of view 208 may narrow upon application of an optical zoom to the projector. In some implementations, a plurality of projectors 206 may be used. Further, in some implementations, the projector 206 may be further configured to project patterns, such as non-visible infrared patterns, that can be detected by camera(s) and used for 3D reconstruction and modeling of the environment. The projector 206 may comprise a microlaser projector, a digital light projector (DLP), cathode ray tube (CRT) projector, liquid crystal display (LCD) projector, light emitting diode (LED) projector or the like.

A camera 210 may also be disposed within the chassis 204. The camera 210 is configured to image the scene in visible light wavelengths, non-visible light wavelengths, or both. The camera 210 may be implemented in several ways. In some instances, the camera may be embodied an RGB camera. In other instances, the camera may include ToF sensors. In still other instances, the camera 210 may be an RGBZ camera that includes both ToF and RGB sensors. The camera 210 has a camera field of view 212 which describes a particular solid angle. The camera field of view 212 may vary according to changes in the configuration of the camera 210. For example, an optical zoom of the camera may narrow the camera field of view 212. In some implementations, a plurality of cameras 210 may be used.

The chassis 204 may be mounted with a fixed orientation, or be coupled via an actuator to a fixture such that the chassis 204 may move. Actuators may include piezoelectric actuators, motors, linear actuators, and other devices configured to displace or move the chassis 204 or components therein such as the projector 206 and/or the camera 210. For example, in one implementation, the actuator may comprise a pan motor 214, tilt motor 216, and so forth. The pan motor 214 is configured to rotate the chassis 204 in a yawing motion. The tilt motor 216 is configured to change the pitch of the chassis 204. By panning and/or tilting the chassis 204, different views of the scene may be acquired. The spatial analysis module 142 may use the different views to monitor objects within the environment.

One or more microphones 218 may be disposed within the chassis 204, or elsewhere within the scene. These microphones 218 may be used to acquire input from the user, for echolocation, location determination of a sound, or to otherwise aid in the characterization of and receipt of input from the scene. For example, the user may make a particular noise, such as a tap on a wall or snap of the fingers, which are pre-designated to initiate an augmented reality function. The user may alternatively use voice commands. Such audio inputs may be located within the scene using time-of-arrival differences among the microphones and used to summon an active zone within the augmented reality environment. Further, the microphones 218 may be used to receive voice input from the user for purposes of identifying and authenticating the user. The voice input may be received and passed to the user identification and authentication module 152 in the computing device 130 for analysis and verification.

One or more speakers 220 may also be present to provide for audible output. For example, the speakers 220 may be used to provide output from a text-to-speech module, to playback pre-recorded audio, etc.

A transducer 222 may be present within the ARFN 102(1), or elsewhere within the environment, and configured to detect and/or generate inaudible signals, such as infrasound or ultrasound. The transducer may also employ visible or non-visible light to facilitate communication. These inaudible signals may be used to provide for signaling between accessory devices and the ARFN 102(1).

A ranging system 224 may also be provided in the ARFN 102 to provide distance information from the ARFN 102 to an object or set of objects. The ranging system 224 may comprise radar, light detection and ranging (LIDAR), ultrasonic ranging, stereoscopic ranging, and so forth. In some implementations, the transducer 222, the microphones 218, the speaker 220, or a combination thereof may be configured to use echolocation or echo-ranging to determine distance and spatial characteristics.

A wireless power transmitter 226 may also be present in the ARFN 102(1), or elsewhere within the augmented reality environment. The wireless power transmitter 226 is configured to transmit electromagnetic fields suitable for recovery by a wireless power receiver and conversion into electrical power for use by active components in other electronics, such as a non-passive screen 116. The wireless power transmitter 226 may also be configured to transmit visible or non-visible light to communicate power. The wireless power transmitter 226 may utilize inductive coupling, resonant coupling, capacitive coupling, and so forth.

In this illustration, the computing device 130 is shown within the chassis 204. However, in other implementations all or a portion of the computing device 130 may be disposed in another location and coupled to the ARFN 102(1). This coupling may occur via wire, fiber optic cable, wirelessly, or a combination thereof. Furthermore, additional resources external to the ARFN 102(1) may be accessed, such as resources in another ARFN accessible via a local area network, cloud resources accessible via a wide area network connection, or a combination thereof.

The ARFN 102(1) is characterized in part by the offset between the projector 206 and the camera 210, as designated by a projector/camera linear offset "O". This offset is the linear distance between the projector 206 and the camera 210. Placement of the projector 206 and the camera 210 at distance "O" from one another aids in the recovery of structured light data from the scene. The known projector/camera linear offset "O" may also be used to calculate distances, dimensioning, and otherwise aid in the characterization of objects within the scene 202. In other implementations, the relative angle and size of the projector field of view 208 and camera field of view 212 may vary. Also, the angle of the projector 206 and the camera 210 relative to the chassis 204 may vary.

Figure 3:
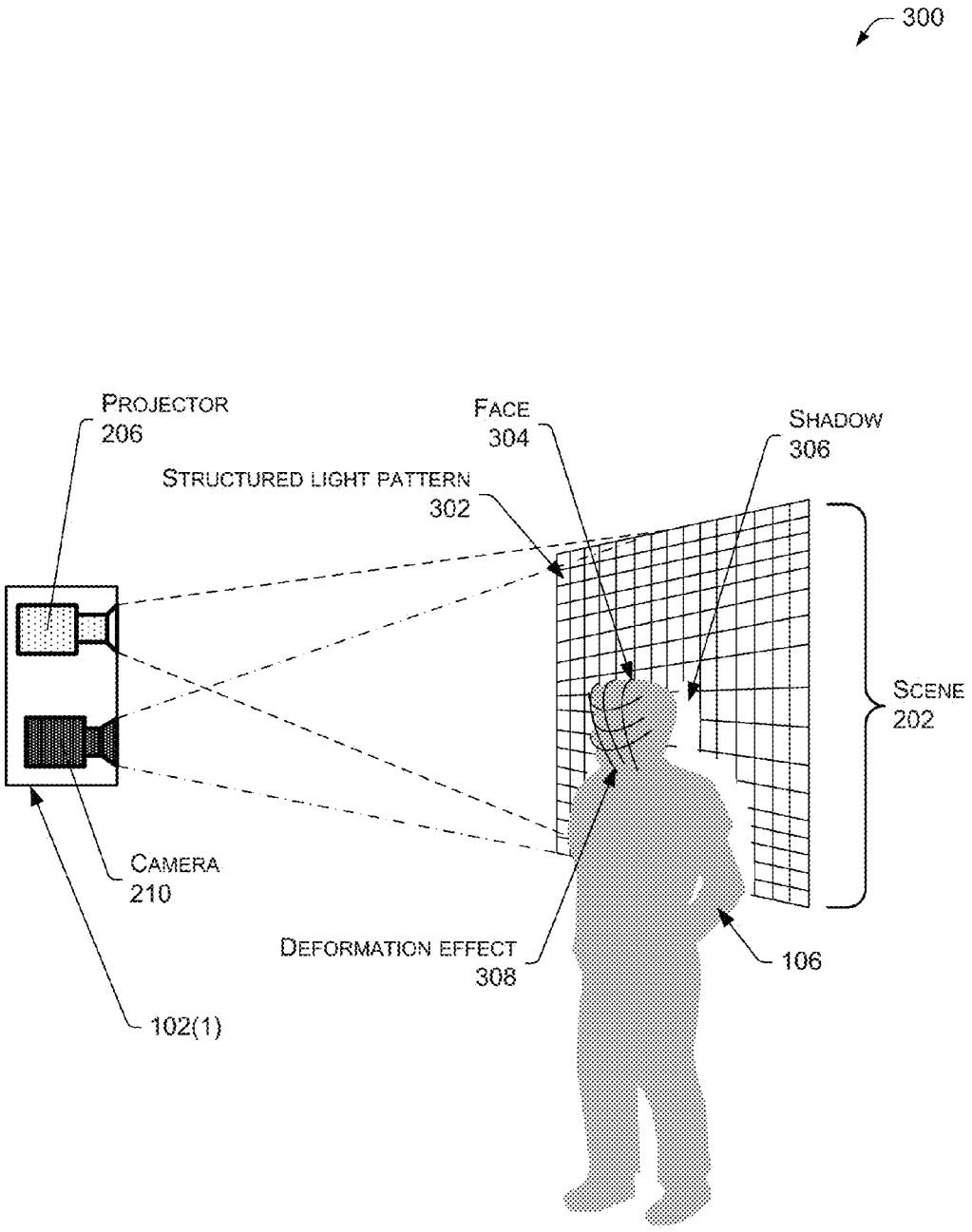
FIG. 3 illustrates one example implementation of creating an augmented reality environment by projecting a structured light pattern on a scene and capturing a corresponding image of the scene.

FIG. 3 illustrates one example operation 300 of the ARFN 102(1) of creating an augmented reality environment by projecting a structured light pattern on a scene and capturing a corresponding image of the scene. In this illustration, the projector 206 within the ARFN 102(1) projects a structured light pattern 302 onto the scene 202. In some implementations, a sequence of different structure light patterns 302 may be used. This structured light pattern 302 may be in wavelengths which are visible to the user, non-visible to the user, or a combination thereof. The structured light pattern 304 is shown as a grid in this example, but not by way of limitation. In other implementations, other patterns may be used, such as bars, dots, pseudorandom noise, and so forth. Pseudorandom noise (PN) patterns are particularly useful because a particular point within the PN pattern may be specifically identified. A PN function is deterministic in that given a specific set of variables, a particular output is defined. This deterministic behavior allows the specific identification and placement of a point or block of pixels within the PN pattern.

The user 106 is shown within the scene 202 such that the user's face 304 is between the projector 206 and a wall. A shadow 306 from the user's body appears on the wall. Further, a deformation effect 308 is produced on the shape of the user's face 304 as the structured light pattern 302 interacts with the facial features. This deformation effect 308 is detected by the camera 210, which is further configured to sense or detect the structured light. In some implementations, the camera 210 may also sense or detect wavelengths other than those used for structured light pattern 302.

The images captured by the camera 210 may be used for any number of things. For instances, some images of the scene are processed by the spatial analysis module 132 to characterize the scene 202. In some implementations, multiple cameras may be used to acquire the image. In other instances, the images of the user's face 304 (or other body contours, such as hand shape) may be processed by the spatial analysis module 132 to reconstruct 3D images of the user, which are then passed to the user identification and authentication module 140 for purposes of verifying the user.

Certain features of objects within the scene 202 may not be readily determined based upon the geometry of the ARFN 102(1), shape of the objects, distance between the ARFN 102(1) and the objects, and so forth. As a result, the spatial analysis module 132 may be configured to make one or more assumptions about the scene, and test those assumptions to constrain the dimensions of the scene 202 and maintain the model of the scene.

Illustrative Speaker Array and Controller

Figure 4:
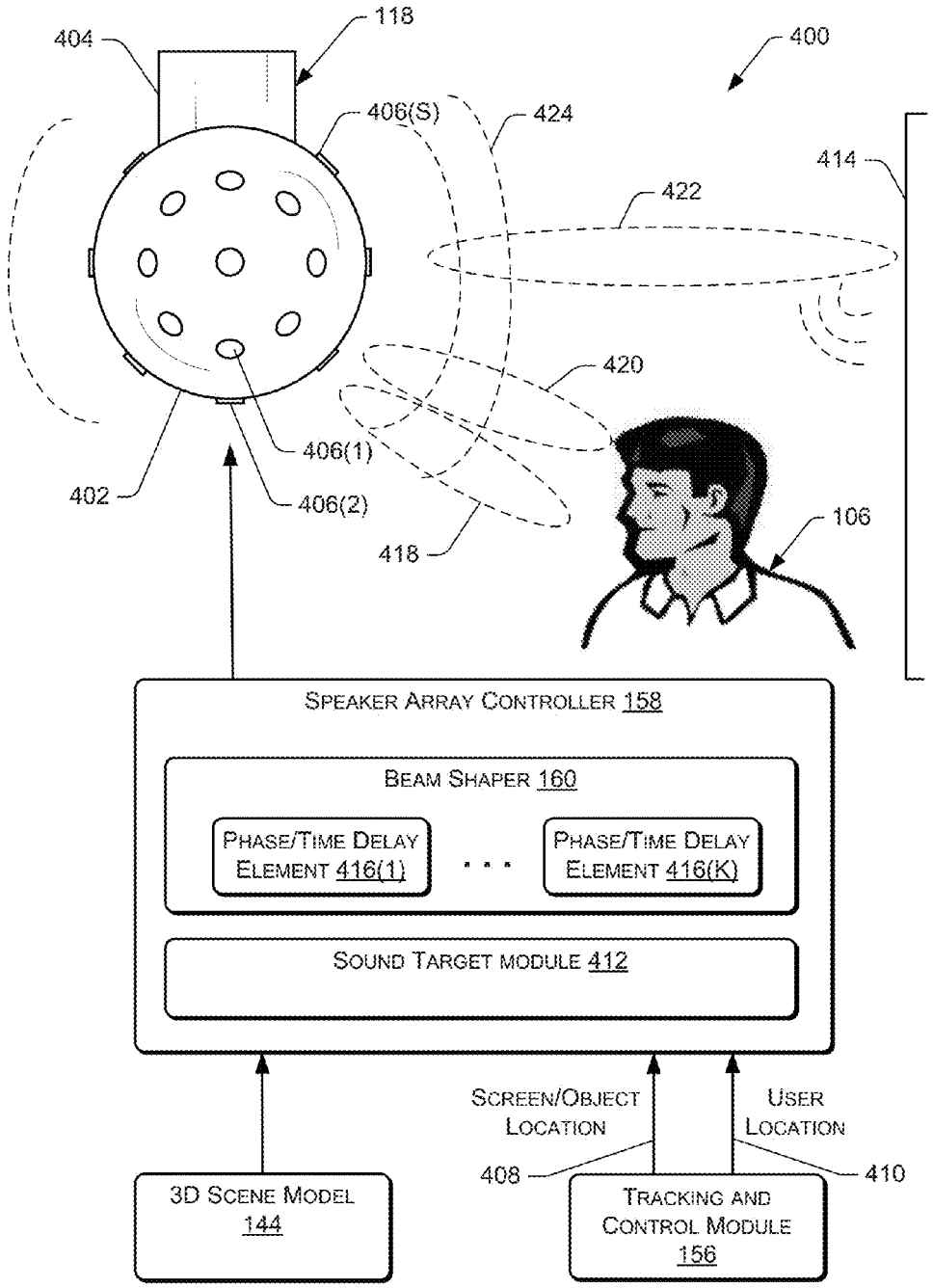
FIG. 4 shows a fixed speaker array and controller for creating a rich sound experience from a single location within the room of FIG. 1.

FIG. 4 shows a sound system 400 having the fixed speaker array 118 and the speaker array controller 158 for creating a rich sound experience from a single location within the room of FIG. 1. The speaker array 118 includes a spherical body 402 attached to a base mount 404. The base mount 404 may be used to secure the speaker array 118 to a fixed and central location within the environment, such as the middle point of a room ceiling as shown in FIG. 1. As an alternative to the spherical shape, the body 402 may be implemented has a hemisphere or other physical shapes, such as a cone, cylinder, or any other shape that allows for omni-directional emission of sound.

The speaker array 118 houses and positions multiple speakers 406(1), 406(2), . . . , 406(S). The speakers 406(1)-(S) may be arranged symmetrically about the sphere, spaced equidistant apart from one another. Moreover, the speakers 406(1)-(S) may be oriented outward along radii of the spherical or hemispherical body 402. However, other arrangements of the speakers about the spherical or hemispherical body 402 may be used.

The speaker array controller 158 is provided to control the individual speakers 406(1)-(S) in the array 118. The speaker array controller 158 receives the 3D scene model 144 from the spatial analysis module 142 to understand the dimensions of the room, permanent structures, objects therein, and so forth. The speaker array controller 158 may also receive data pertaining to the screen/object location(s) 408 and user location(s) 410 from the tracking and control 156. These locations help the speaker array controller 158 determine various targets for sound output.

A sound target module 412 receives the 3D scene model 144, the screen/object location(s) 408, and the user location(s) 410 and based on this information, determines possible regions for sound localization or directive output. Shown in FIG. 4, suppose the user 106 is positioned beside a right side wall 414, but facing leftward to look across the room. For instance, the user may be watching a movie being projected on an opposing wall across the room, similar to that shown in FIG. 1. In this situation, the 3D scene model 144 provides dimension data, such as a distance from the speaker array 118 to the wall 414, to the sound target module 412. It is noted that the 3D scene model 144 may be created automatically, such as by the spatial analysis module 142. Alternatively, 3D scene model 144 may be captured by measuring the physical layout of the room and cataloging the objects in the room. The tracking and control module 156 provides updated location information for any objects moving about the scene or when the user 106 moves about the room.

From this information, the sound target module 412 determines one or more places to direct sound. The list of locations is provided to the beam shaper 160 to form one or more directional sound beams. One or more phase/time delay elements 416(1), . . . , 416(K) are provided to manipulate the audio signals provided to the speakers 406 (1)-(S) to cause formation of beams having a desired strength, direction, and duration. For example, in one implementation, by controlling the timing and characteristics of the signals provided to multiple speakers, the sound waves output by the chosen speakers reinforce in the desired direction while canceling in other directions. This reinforcing enables emission of a sound beam in a targeted direction. In this manner, people in that directional sound beam path can more clearly hear the audio sound, while the sound is faint or imperceptible to people in other directions that are not in the sound beam path. In FIG. 1, the speaker array 118 is shown outputting several directed sound beams as indicated by the dashed ovals.

Continuing our example, suppose the user is watching a movie on the far wall (not shown). A first sound beam 418 and a second sound beam 420 represent respective left and right channels of a stereo signal. The first sound beam 418 may be created through use of 2-3 speakers in the speaker array 118. The second sound beam 420 may be created by a different collection of speakers, which may or may not include one or more speakers involved in the creation of both beams. The first and second sound beams may be slightly spaced in time to effectuate a stereo experience for the user 106. For instance, the first sound beam 418 may be delayed slightly relative to the second sound beam 420, where the delay and order of which speaker is fired first depends in part on the location of the user relative to the speaker array 118 and the surface onto which the movie is projected.

A third sound beam 422 is shown output in a rightward direction relative to the speaker array 118. The sound beam is directed to the wall 414 and reflected back to the user 106. This third sound beam 422 thereby provides the backend surround sound components for an enhanced audio experience. The speaker array 118 may further emanate base sound waves 424, essentially serving the function of a woofer in a full spectrum sound experience.

Accordingly, the fixed-location speaker array 118 is capable of producing a rich audio experience, such as surround sound and full spectrum stereo. Additionally, the fixed-location speaker array 118 is capable of producing localized sounds within the environment.

Illustrative Process

Figure 5:
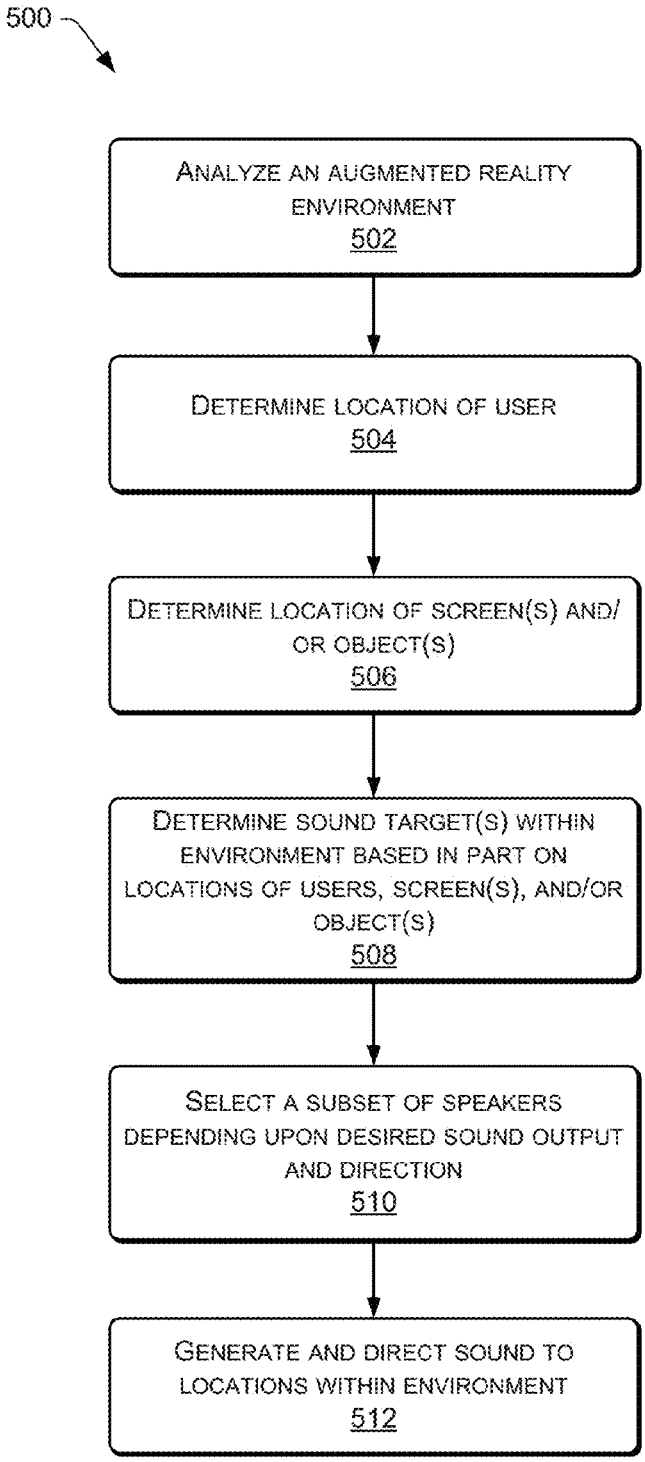
FIG. 5 shows an illustrative process of providing rich audio output within an enhanced augmented reality environment using a fixed location speaker array.

FIG. 5 shows an illustrative process 500 of providing an enhanced augmented reality environment using a projection and camera system that shares a common optics path. The processes described herein may be implemented by the architectures described herein, or by other architectures. These processes are illustrated as a collection of blocks in a logical flow graph. Some of the blocks represent operations that can be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order or in parallel to implement the processes. It is understood that the following processes may be implemented with other architectures as well.

At 502, an environment for an augmented reality is analyzed. In one implementation, this may be done automatically, for example, using the spatial analysis module 142. In another implementation, a map may be formed by physically measuring the dimensions of the environment relative to the ARFN and speaker array and entering these dimensions into an electronic record for consumption by the speaker array controller 158.

At 504 and 506, locations of one or more users, screens or projection surfaces, and/or other objects are determined. Generally, objects may be any item, person, or thing within the environment being analyzed. Special cases of the objects—people and screens—are called out for discussion purposes. This functionality may be performed, for example, by the tracking and control module 156 on the ARFN 102.

At 508, sound targets are determined within the environment based, at least in part, on the 3D map and locations of the user(s), screen(s), and/or object(s). This functionality may be performed by the sound target module 412.

At 510, a subset of one or more speakers from the speaker array is selected depending upon a desired beam shape, direction, and orientation. The beam shaper 160 selects the combination of speakers based on their location on the spherical- or hemispherical-shaped body 402 and ability to direct sound to a select location within the environment so that the sound is more perceptible at the select location than other locations.

At 512, sound is generated and directed at certain target locations within the environment. The various beams may be generated by controlling the individual selected speakers within the speaker array 118. For instance, a set of 2 or 3 speakers may be used to generate a directional beam of sound by controlling the timing of the sound signal going to each speaker in the set.

CONCLUSION

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A device comprising:

a body having a curved outer surface;

a plurality of speakers mounted in the body; and a speaker array controller to control individual speakers in the plurality of speakers, the speaker array controller comprising:

a sound target module to:

receive a model representing at least one of an inventory of objects within an environment or one or more physical boundaries of the environment from a second device within the environment; and determine a location at which to direct sound based at least in part on the model of the environment, the location comprising a surface on which an image is displayed within the environment; and a beam shaper to cause a set of speakers from the plurality of speakers to produce sound that, when output, is more perceptible at the location determined by the sound target module than other locations.

2. The device of claim 1, wherein the body is one of spherical shaped or hemispherical shaped.

3. The device of claim 1, wherein the body has a base for mounting the device in a fixed location within the environment.

4. The device of claim 1, wherein the body has at least a partial spherical shape and the plurality of speakers are oriented outward along radii of the spherical body.

5. The device of claim 1, wherein the model of the environment further comprises dimensions of the environment.

6. The device of claim 1, wherein the model of an environment further comprises a person or an object within the environment and the location further comprises at least one of the person or the object within the environment.

7. A device comprising:

a body;

a plurality of speakers mounted in the body to output sound within an environment; and a speaker array controller to:

receive, from a second device, an indication of a surface on which an image is displayed within the environment;

receive, from the second device, location information of at least one person within the environment;

identify one or more directions at which to direct sound based at least in part on the indication, the location information, and the surface on which the image is displayed within the environment;

cause the speakers to direct sound in the one or more identified directions from the body to provide at least one of surround sound or stereo sound.

8. The device of claim 7, wherein the surface of the body has one of a hemispherical shape or a spherical shape.

9. The device of claim 7, wherein the location comprises a first location and the speaker array controller model of the environment further receives second location information of at least one object within the environment.

10. The device of claim 9, wherein the speaker array controller identifies, based at least in part on the second location information, one or more locations to direct the sound.

11. The device of claim 7, wherein the speaker array controller is further to control a timing or a strength of sound waves output by each of the plurality of speakers.

12. A method comprising:

controlling individual speakers in a plurality of speakers of a first device, the plurality of speakers to emit the sound in multiple directions;

receiving a model representing at least one of objects present in an environment or one or more physical boundaries of the environment from a second device;

determining a location at which to direct sound from one or more of the plurality of speakers based at least in part on the model, the location corresponding to a surface within the model which displays an image within the environment; and causing a set of multiple speakers from the plurality of speakers to emit sound waves that, when output, combine to direct the sound toward the location in the environment so that the sound is more perceptible at the location than other locations within the environment.

13. The method of claim 12, wherein the body is spherical or hemispherical shaped and further comprising controlling various combinations of the plurality of speakers to output sound radiantly outward from the spherical or hemispherical shaped body.

14. The method of claim 12, further comprising analyzing the environment using a camera system to image the environment to produce the model.

15. The method of claim 12, wherein the causing comprises directing the set of multiple speakers to emit sound waves that, when output, combine to reflect from a feature in the environment toward the location.

16. The method of claim 12, further comprising determining a presence of a user in the environment and determining the location based in part on the presence of the user.

17. The device of claim 7, wherein the body has a base for mounting the device in a fixed location within the environment.

18. The device of claim 7, wherein the body has at least a partial spherical shape and the speakers are oriented outward along radii of the spherical body.

19. The method of claim 12, further comprising:

receiving a second model of the environment from the second device;

detecting a change in a position of the surface based at least in part on the second model;

determining a second location in the environment at which to direct sound from one or more of the plurality of speakers, the second location corresponding to the change in the position of the surface within the second model; and causing the set of multiple speakers from the plurality of speakers to emit sound waves that, when output, combine to direct the sound toward the second location in the environment so that the sound is more perceptible at the second location than other locations within the environment.

* * * * *